US005413328A

United States Patent [19]

Glancey et al.

[11] Patent Number: 5,413,328

[45] Date of Patent: May 9, 1995

[54] BODY SUPPORTED SPORTS TARGET AND METHOD

[75] Inventors: Timothy F. Glancey, 2929 Alamo Dr., Orlando, Fla. 32805; Walter H. Nickel, Orlando, Fla.; Jeffrey S. Deceder, Orlando, Fla.

[73] Assignee: Timothy F. Glancey, Orlando, Fla.

[21] Appl. No.: 199,478

[22] Filed: Feb. 22, 1994

Related U.S. Application Data

[63] Continuation-in-part of Ser. No. 753,675, Sep. 3, 1991, Pat. No. Des. 344,558, and a continuation-in-part of Ser. No. 634,501, Dec. 26, 1990, Pat. No. Des. 344,394.

[51] Int. Cl.[6] ..... A63B 67/00

[52] U.S. Cl. ..... 273/1.5 A; 273/55 D; 273/57.2; 273/400; 273/401; 273/DIG. 17

[58] Field of Search ..... 273/1.5 R, 1.5 A, 55 D, 273/57.2, 398, 400, 401, 402, 411, 412, DIG. 17, DIG. 18, DIG. 19

[56] References Cited

U.S. PATENT DOCUMENTS

| | | | |
|---|---|---|---|
| D. 344,394 | 2/1994 | Livera et al. | D21/201 X |
| D. 344,558 | 2/1994 | Livera et al. | D21/201 |
| 3,035,838 | 5/1962 | Johnston | 273/400 |
| 3,163,419 | 12/1964 | Lemelson | 273/401 |
| 3,628,794 | 12/1971 | Conture | 273/DIG. 17 X |
| 3,810,616 | 5/1974 | Murphy | 273/402 X |
| 5,192,080 | 3/1993 | Duncan | 273/1.5 RX |
| 5,222,259 | 6/1993 | Bristor | 273/1.5 RX |
| 5,280,917 | 1/1994 | Lopez Ortiz | 273/DIG. 17 X |

OTHER PUBLICATIONS

Brochure Winter/Spring 1994 Timothy F. Glancey; Sports Magic Team, Inc.

*Primary Examiner*—William H. Grieb

*Attorney, Agent, or Firm*—Allen, Dyer, Doppelt, Franjola & Milbrath

[57] ABSTRACT

To entertain fans at sporting events, such as baseball, basketball backboards, palm trees, hockey and soccer goals are provided as targets for fans to participate by tossing objects at the target. Targets are strapped to a person moving through the stands. In one configuration the target is attached to a backpack and raised over the head using a telescoping mechanism attached between the target and the backpack worn by the operator. In another configuration the target is attached to a helmet worn by the person working the crowd. Both the helmet and backpack arrangement use mounting brackets for attachment of the target members. To telescope the target overhead from the backpack, concentric tubes are extended from within each other using a pulley and cable system controlled by the operator.

41 Claims, 7 Drawing Sheets

BODY SUPPORTED SPORTS TARGET AND METHOD

CROSS REFERENCE TO RELATED APPLICATIONS

This application is a continuation-in-part of application Ser. No. 07/753,675 filed Sep. 3, 1991 for a Body Supported Basketball Hoop, issuing on Feb. 22, 1994 as U.S. Pat. No. 344,558 and application Ser. No. 07/634,501 filed Dec. 26, 1990 for a Basketball Hoop Helmet, Issuing on Feb. 22, 1994 as U.S. Pat. No. 344,394.

BACKGROUND OF INVENTION

1. Field of Invention

The invention relates generally to entertainment of sports fans and other group events during breaks in the event action, and more particularly to a body supported target carried by one person so that another person can toss an object at the target.

2. Background Art

Early in 1990, during the Orlando Magic's first season in the NBA, it was realized that traditional magic tricks and routines would not effectively entertain fans during intermissions at such sporting events. The basketball hoop helmet referenced in the copending application was introduced at this time. It became one of the most popular props introduced at the basketball events and satisfied the need to entertain fans during breaks in the sporting event itself. During the second season for the Orlando Magic, it was realized that a prop was needed that would have the impact and crowd interaction that was provided by the basketball hoop helmet but with more visibility so that a larger portion of the crowd could be entertained. The body supported basketball hoop was introduced at this time. With the success seen at basketball games, it was appreciated that similar success could be realized for other sporting events such as hockey, baseball and certain rock styled concerts. The development of alternative target elements described within this specification began to emerge.

Entertainment of the fans during intermission and breaks in the play provided "the play between the plays". The sports targets of the copending applications satisfied the need to entertain the crown during breaks in the action. The need to provide audience interaction could be found with improvements to these target devices.

SUMMARY OF INVENTION

A body supported sports target comprises a target member having an image fixed to a surface of the target member. A perimeter of the member is dimensioned to form a silhouette of the image being displayed. A container is affixed to the target member at a location for receiving an object tossed at the target member. The container has an open portion for receiving the object and a closed portion for holding the object. Means for affixing the target to a person operating the target is provided.

In one embodiment of the invention, a multiplicity of concentric generally tubular members are affixed to the target member. Means for telescoping the tubular members from a first position wherein the tubular member distal ends are proximate each other to a second position wherein the distal ends are separated by a distance sufficient to extend the target member to a predetermined position above a head of the person operating the target. In the preferred embodiment, three tubular members are used. An outermost member is attached to the affixing means. A center member is placed within a bore of the outermost member and an innermost member is placed within a bore of the center member. A first pulley is rotatably affixed to the outermost member distal end. The first pulley is dimensioned to receive and direct cable passing from within the outermost member to a position proximate a person operating the target. A second cable having first and second ends has its first end affixed within the outermost member to the center member of the center member proximal end and extends from the proximal end through the first pulley to a position proximate the person operating the target. The position is convenient for that person to hold a loop affixed within a cable second end for pulling the cable and causing the center member to telescope out of the outer member. A second pulley is rotatably affixed to the center member distal end. The second pulley is dimensioned to receive and direct the cable passing from within the center member to a position proximate the outer member distal end. A second cable having first and second ends is affixed at the first end within the center member to the innermost member proximal end. The second cable extends from the innermost member proximal end through the second pulley to a position wherein the cable second end is affixed to the outermost tubular member distal end. Such an arrangement causes the center member to telescope the innermost member out of the center member when the center member is telescoping out of the outermost member from the action of the person pulling on the first cable second end.

In alternate embodiments of the target member, various target members are made a part of the sports target. The various members take on the image of a palm tree, a squatting baseball catcher, an automobile tire, a hockey goal, a soccer goal, and an arena football goal.

It is an object of the invention to provide a target to be carried by one person for another person to toss an object at the target and collected in a container affixed to the target. It is further an object of the invention to be able to raise the target from one position where it is stored behind the person carrying the target to an elevated position in clear view of the crowd and the person tossing the object at the target. It is yet another object of the invention to provide various images of the target and objects for the person tossing an object at the target.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENT

Figure 1:
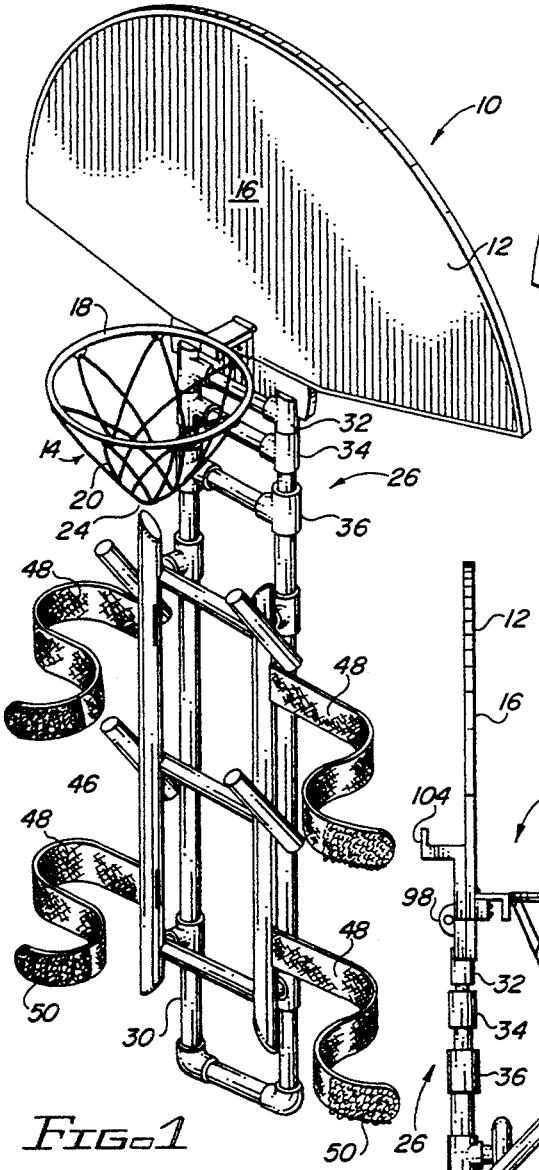
FIG. 1 is a perspective view of the present invention illustrating a basketball backboard and basket affixed above extendable tubular members wherein the tubular members are affixed to a backpack assembly for attachment to a person operating the invention.
Figure 2:
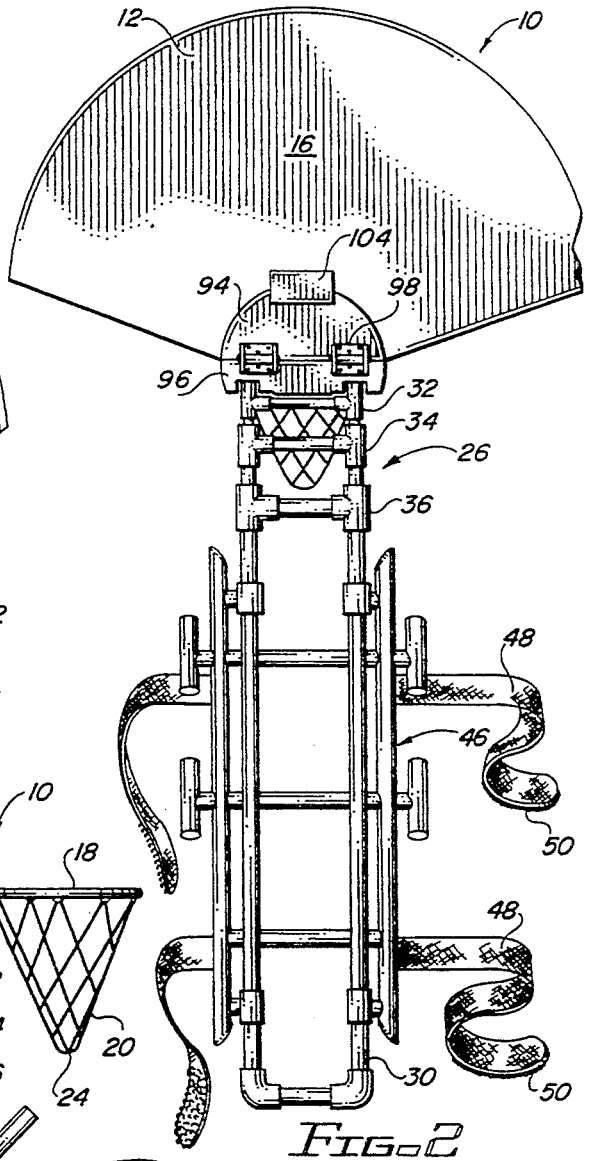
FIG. 2 is a rear view of the target described in FIG. 1.
Figure 3:
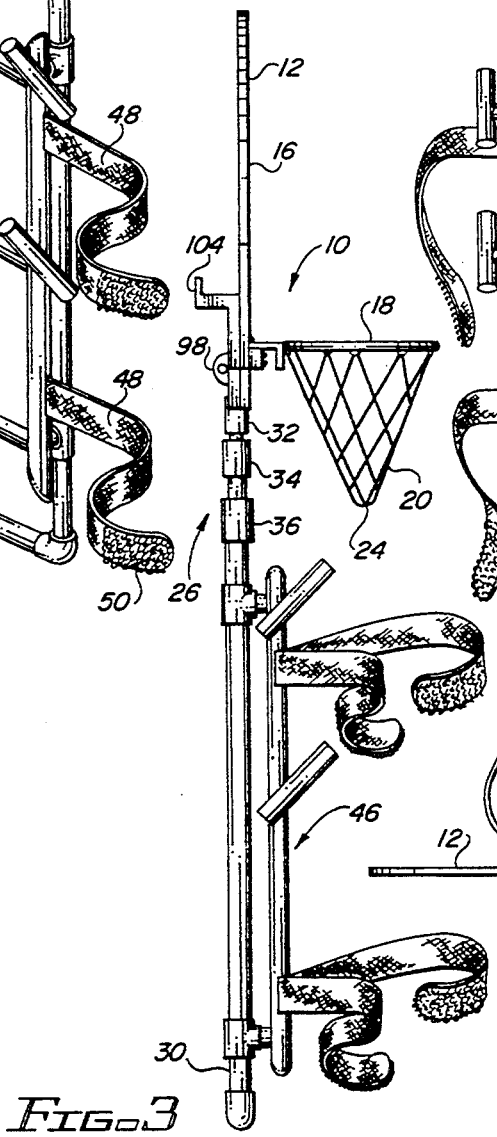
FIG. 3 is a side view of the target described in FIG. 1.
Figure 4:
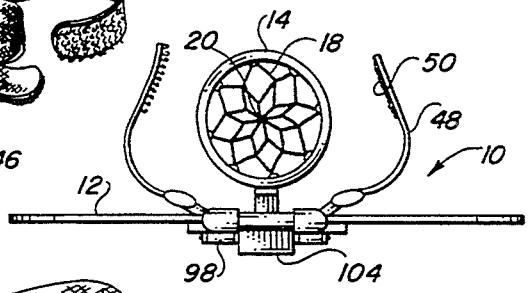
FIG. 4 is a top view of the target described in FIG. 1.

An above referenced copending application illustrates a body supported basketball hoop. In the preferred embodiment of the invention the body supported basketball hoop is extended to include a body supported sports target as illustrated in the accompanying drawings. With reference to FIGS. 1–4, the sports target 10 comprises a target member 12. A container 14 is affixed to the target member 12 for receiving and holding an object tossed at the target 10. In the copending application, the target member 12 and container 14 were represented by a basketball backboard 16, a basket fixed to the backboard 18 and a closed net 20 for the bracket 18. The container 14 has an open portion 22 for receiving an object tossed at the target member 12 and a closed portion 24 for holding the object. A multiplicity of concentric hollow generally tubular members 26 having distal ends 28 and proximal ends 30 are dimensioned to fit within one another. In the preferred embodiment an innermost tubular member 32 is dimensioned to fit within a center tubular member 34. In turn the center tubular member 34 is dimensioned to fit within an outermost tubular member 36 as illustrated in FIGS. 1–3 and FIGS. 5 and 6. The preferred embodiment of the present invention uses tubular member pairs as illustrated in FIGS. 1–6 and in more detail in FIGS. 7A, B and C. The innermost members 32, center member 34, and outermost member 36 are separated at their distal ends 28 respectively by cross bars 38, 40 and 42. The outermost tubular members 36 have a second cross bar 44. The cross bars serve to hold the tubular member pairs in parallel with each other.

With further reference to FIGS. 1–4, the outermost tubular members 36 are affixed to a backpack assembly 46 for affixing the target to the back of a person carrying the target 10. The backpack assembly 46 is dimensioned to fit on the person's back and be removably affixed to the body of the person using straps 48. In the preferred embodiment of the present invention, hook and pile fastener portions were affixed to strap ends 50 for easy attachment and removal of the straps 48 and target 10 from the person carrying the target 10.

Figure 5:
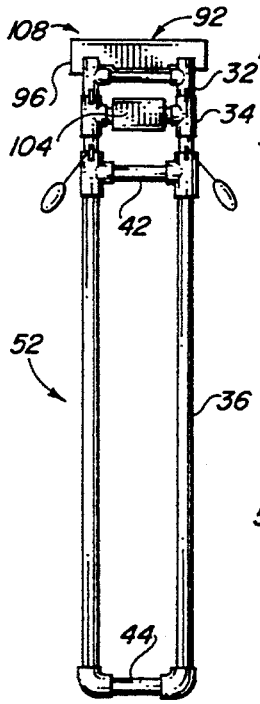
FIG. 5 is a partial view of the target illustrating a first position of tubular members.
Figure 6:
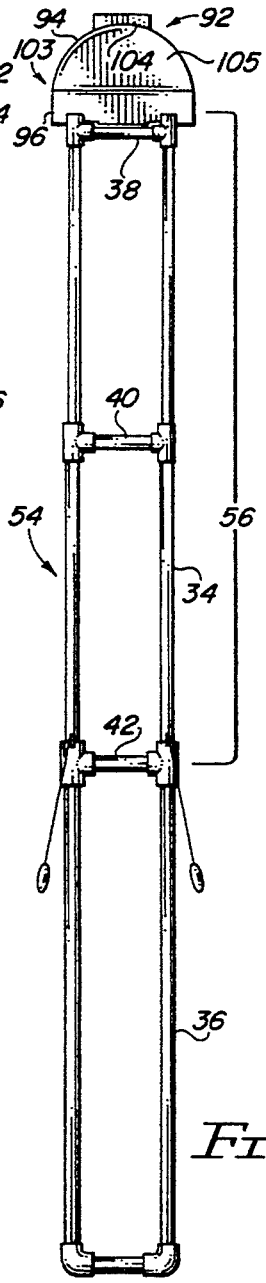
FIG. 6 is a partial view of the target illustrating a second position of the tubular members wherein the concentric tubular members are telescoped to a predetermined distance for raising a target member over the head of a person operating the target.
Figure 8:
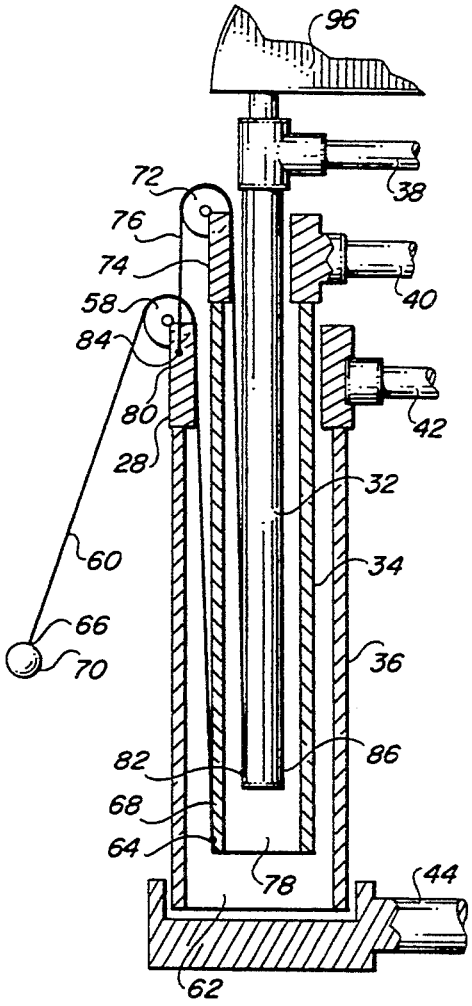
FIG. 8 is a partial cross sectional view of the concentric tubular members illustrating the telescoping mechanism having a pulley and cable arrangement.
Figure 7A:
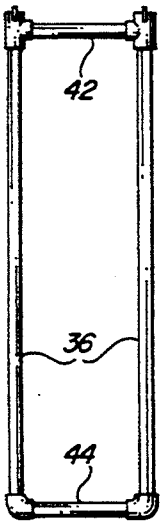
FIGS. 7*a, b* and *c* further illustrate the tubular members comprising an outermost member, center member, an innermost member respectively.
Figure 7B:
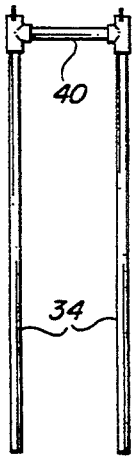
Figure 7C:
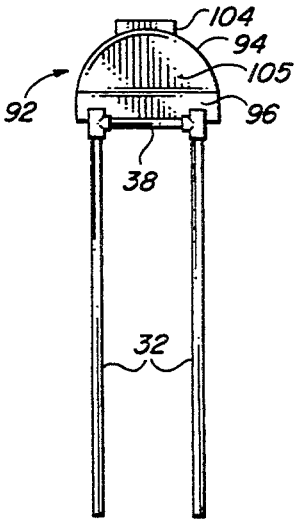

The concentric tubular members 32, 34 and 36 are loosely fitted for slidably telescoping from a first position 52 as illustrated on FIG. 5 wherein the tubular member distal ends 28 are proximate each other to a second position 54 as illustrated in FIG. 6 wherein the distal ends 28 are separated by a distance 56 sufficient to extend the target member 12 affixed to the innermost member distal end 28 a predetermined distance above the head of a person operating the target. With reference to FIG. 8, a mechanism used in the preferred embodiment for telescoping the tubular members 32, 34 and 36 has a first pulley 58 affixed to the distal end 28 of the outermost tubular member 36. The first pulley 58 is dimensioned to receive and direct a first cable 60 passing from within a bore 62 of the outermost member 36 to a position proximate a person operating the target 10. The first cable 60 has a first end 64 and a second end 66.

Figures 9A, 9B, 10, 11:
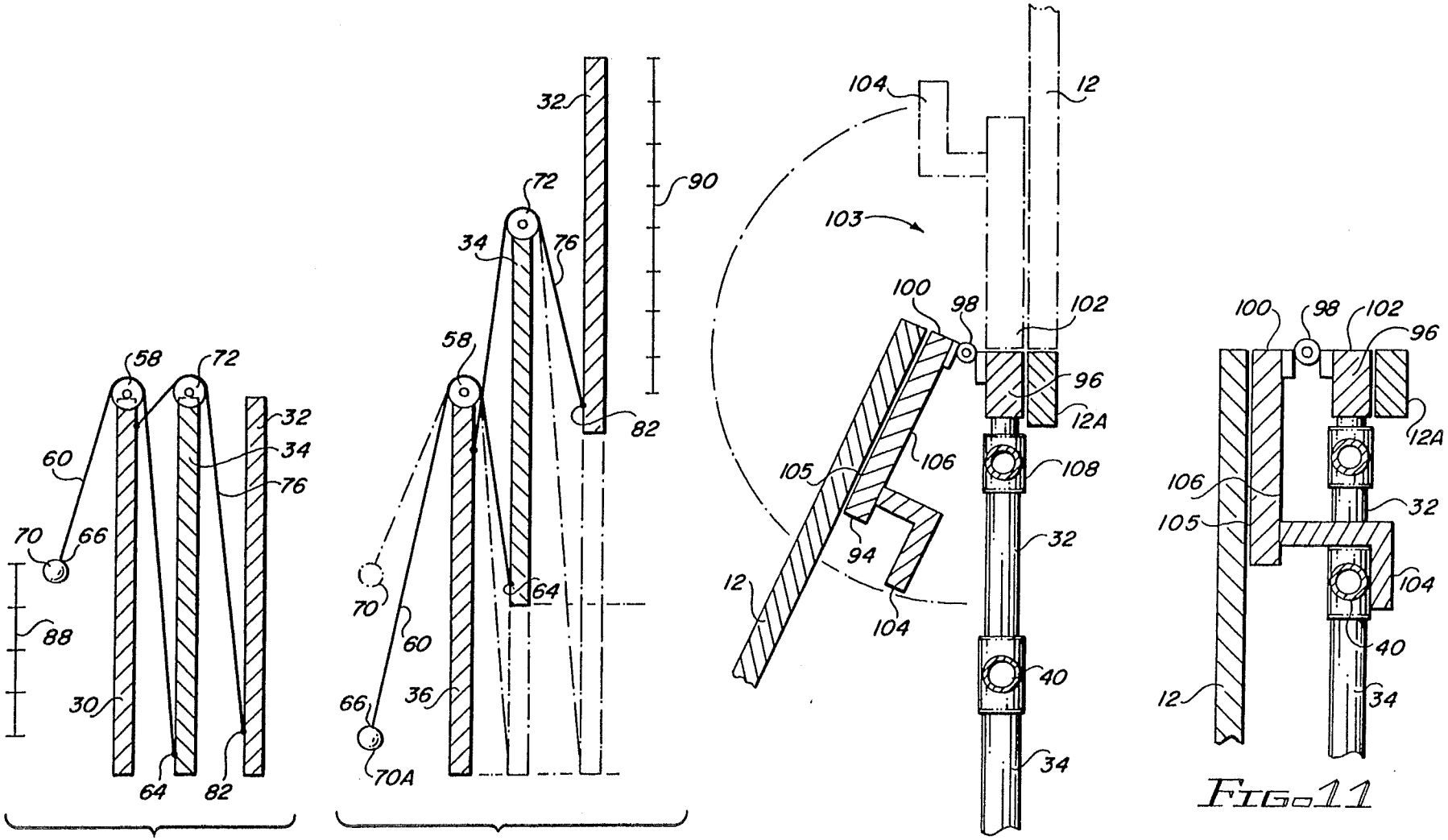
FIGS. 9*a* and 9*b* further illustrate the arrangement as described in FIG. 8 for tubular members arranged in a first position and a telescope second position, respectively.
FIG. 10 is a partial cross sectional side view of a foldable bracket affixed between a target member and the tubular member wherein a bracket top portion moves from a second position to a first position from the biasing forces of a spring hinge.
FIG. 11 is a partial cross sectional side view of the bracket as described in FIG. 10 wherein a hook portion of the bracket is removably affixed to a tubular member cross bar for holding the bracket in the second position.

The cable first end 64 is affixed to the center member 34 at its proximal end 68 and extends from the proximal end 68 through the first pulley 58 to a position proximate the person operating the target 10. In the preferred embodiment, a loop 70 is affixed to the cable second end 66 and the second end 66 is placed at a position convenient for the person carrying the target 10 to hold the loop 70 in his hand. Again with reference to FIG. 8, a second pulley 72 is rotatably affixed to the center member distal end 74. The second pulley 72 is dimensioned to receive and direct a second cable 76 which passes from within a bore 78 of the center member 34 to a position 80 on the outermost member distal end. The second cable 76 has a first end 82 and a second end 84. The second cable first end 82 is affixed within the center member bore 78 to a proximal end 86 of the innermost member 32. The second cable 76 extends from the innermost member proximal end 86 through the second pulley 72 to the position 80 wherein the second cable second end is affixed to the outermost tubular member distal end 28. With such an arrangement, pulling on the loop 70 will cause the first cable 60 to lift the center member 34 out of the outermost member 36. In turn the second cable 76 having its second end 84 affixed at the distal end position 80 and its first end affixed at the proximal end 86 of the innermost member 32 will lift the innermost member 32 out of the center member 34 thereby providing the telescoping action of the tubular members from their first position 52 as illustrated in FIG. 5 to their second position as illustrated in FIG. 6. The above discussion referencing FIG. 8 is further illustrated with reference to FIG. 9 showing a partial cross sectional view of walls of the tubular members. When the loop 70 illustrated in FIG. 9*a* is pulled to a position 70A as illustrated in FIG. 9*a*, a distance by way of example of four units, the innermost tubular member is telescoped outward by eight units 90. It is anticipated that one skilled in the art will include a multiplicity of tubular members in combination with pulleys and cable as taught by the present invention.

The present invention of the sports target 10 further comprises a foldable bracket 92 which has a top portion 94 rotatably affixed to a bottom portion 96 using a spring hinge 98. The spring hinge 98 biases an end 100 of the top portion 94 to an end 102 of the bottom portion 96 for holding the portions 94 and 96 in a first position 104 as illustrated in FIG. 10. The target member 12 is affixed to a front face 105 the bracket top portion 94. As will be illustrated by way of example later in this description, target member bottom portions 12A are affixed to the bracket bottom portion A hook member 104 is affixed to a back face 106 of the bracket top portion 94. With reference to FIG. 11, the hook member 104 pulls the foldable bracket in a second position 108 when the tubular member distal ends are proximate each other and in particular hooks onto the center member cross bar 40. As the innermost tubular member telescopes away from the center member cross bar 40, the hook member 104 is released from the center member cross bar 40. The spring hinge 98 causes the bracket top portion 94 to be rotated away from the center member cross bar 40 and into its first position 104 again as illustrated in FIG. 10.

Figure 12:
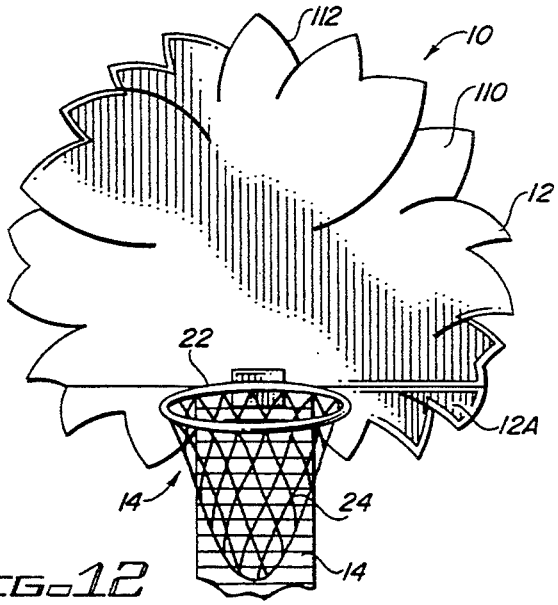
FIG. 12 is a partial perspective front view of a target member in the image of a palm tree.
Figure 13:
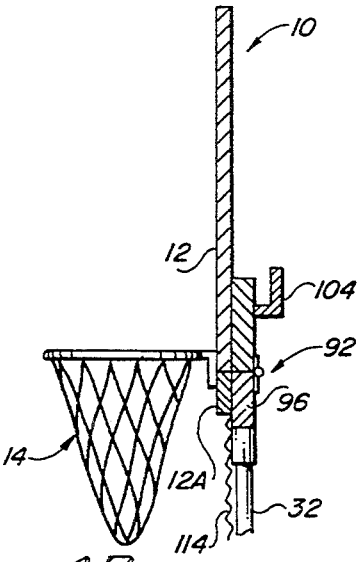
FIG. 13 is a partial cross sectional side view of the target member described in FIG. 12.

With reference to FIGS. 12 and 13, one embodiment of the preferred invention includes the target member 12 dimensioned to have a silhouette in the form of palm fronds 110 and a target member perimeter 112 dimensioned to form the silhouette of palm fronds 110. A curtain 114 has a first end 116 affixed to the bracket bottom portion 96 and a curtain second end 118 fixed to the outermost tubular member distal end 28. In the preferred embodiment, the curtain 114 is made from a foldable blind permitting the curtain 114 to be neatly folded like an accordion in a folded curtain position 120 as illustrated in FIG. 114A and extended to an extended curtain position 122 as illustrated in 14B when the tubes 32, 34 and 36 are telescoped to their predetermined extended distance 56 as was discussed with reference to FIG. 6.

Figures 14A, 14B, 25, 31, 32:
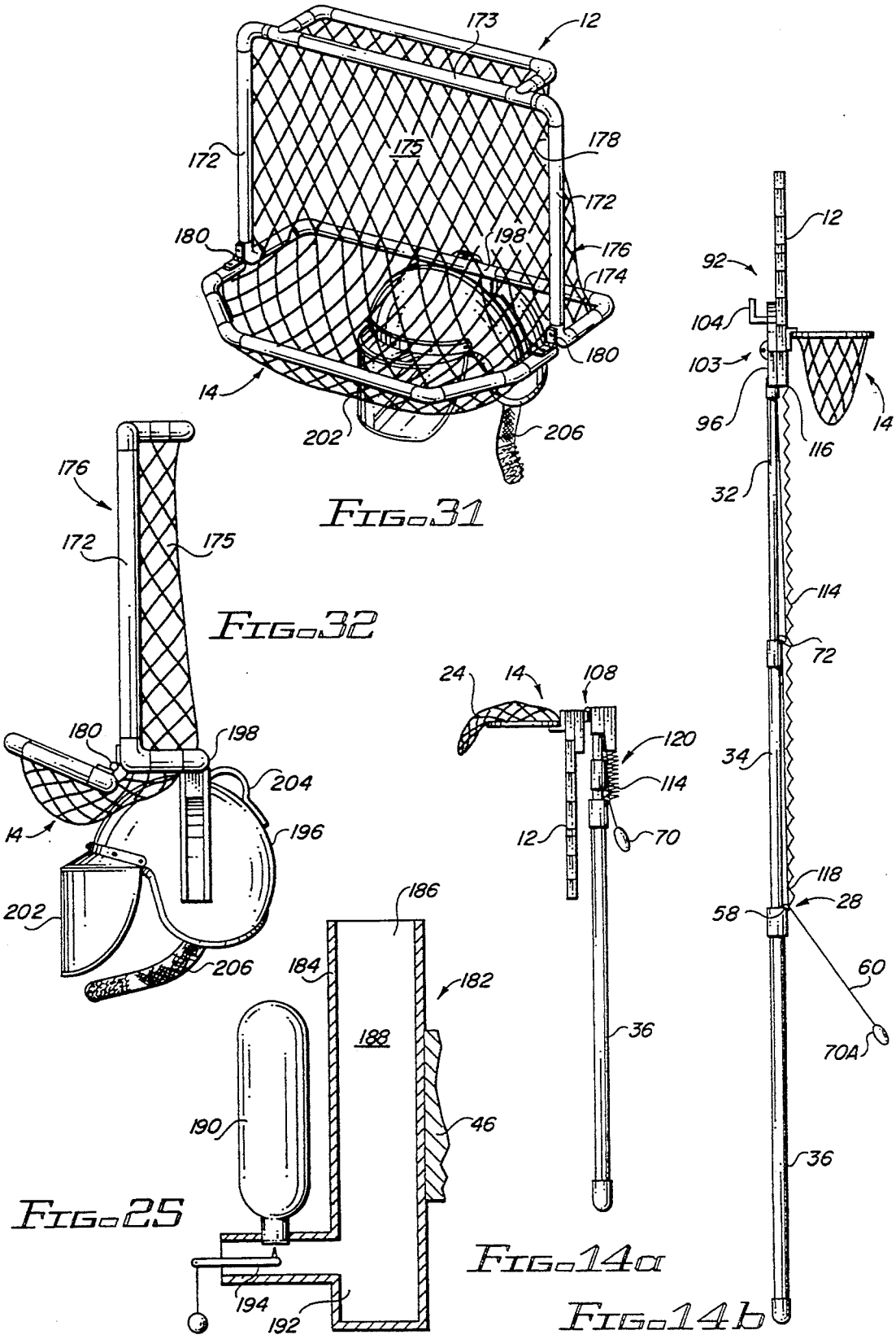
FIGS. 14*a* and *b* illustrate the palm tree target member described in FIGS. 12 and 13 is a first position wherein the target member is folded behind a person operating the target to an extended position where the target member can be viewed by a person tossing an object at the target member.
FIG. 25 is a partial cross sectional view of a firing tube.
FIG. 31 is an alternate embodiment of the present invention wherein a target member in the form of a soccer goal is affixed to a helmet.
FIG. 32 is a side elevational view of the embodiment illustrated in FIG. 31.

Again with reference to FIGS. 10 and 11 and further to FIG. 14A, while the two distal ends 28 proximate each other, the target member 12 can be folded to a storable position wherein the target member 12 affixed to the bracket back face 106 is held in the stored position by the hook 104 as discussed earlier. As the cable 70 is pulled to a position 70A as was discussed with reference to FIGS. 9A and 9B and further illustrated in FIG. 14B, the tubes 32, 34 and 36 are telescoped to a position wherein the target member 12 is brought to an upright position facing a person tossing an object at the target member and in the case of the palm tree image for a preferred embodiment of the present invention, the palm fronds 110 and extended curtain 114 present an image of a palm tree to that person tossing the object. In the preferred embodiment, a target member bottom portion 12A as illustrated in FIGS. 10 and 11 and further illustrated in FIG. 13, is positioned over the bracket bottom portion 96 to present a more complete image of the palm fronds 110 while camouflaging the bracket 92.

Figure 15:
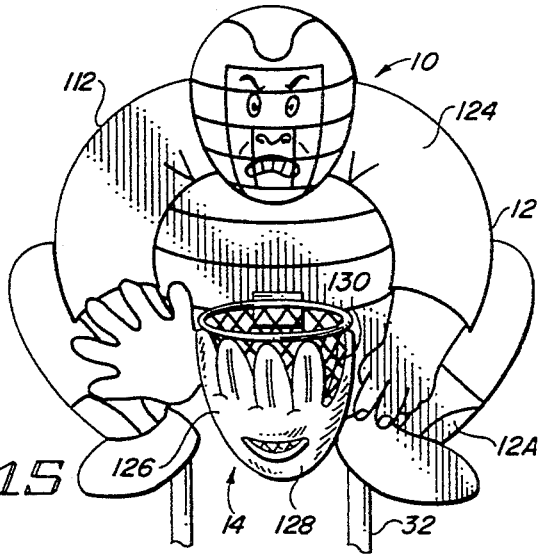
FIG. 15 is a perspective front view of target member mentioned in the image of a baseball catcher.
Figure 16:
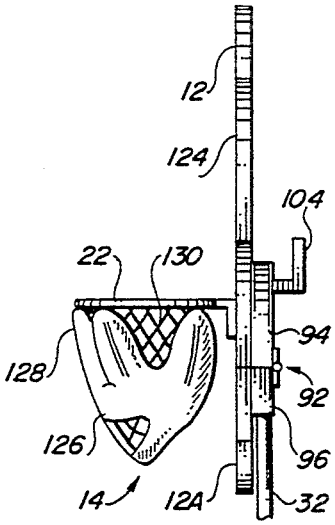
FIG. 16 is a side view of the baseball catcher target member described in FIG. 15.

As illustrated in FIGS. 15 and 16, yet another embodiment of the preferred invention includes the target member 12 dimensioned in the shape of a squatting baseball catcher 124. The target member perimeter 112 further forms the silhouette of the catcher 124. The container 14 affixed to the target member 12 is formed in the shape of a catcher's mitt 126 having fingers 128 and webbing 130 forming the closed portion 24 of the container 14. In a manner as discussed earlier, the target member 12 is affixed to the bracket top portion 94 and a target member bottom portion 12A is affixed to the bracket bottom portion 96 to camouflage the bracket 92 from that person tossing an object at the target member 12.

Figure 17:
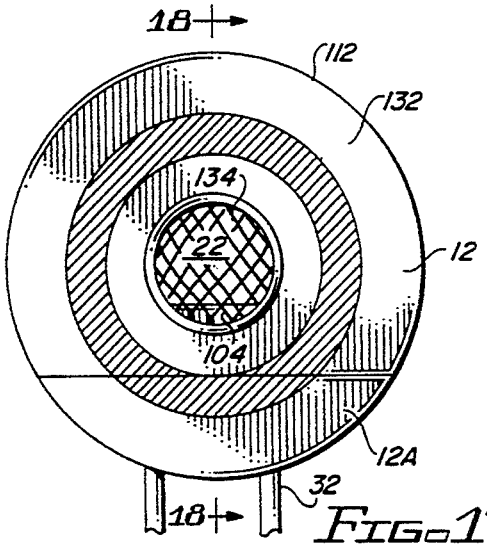
FIG. 17 is a perspective front view of the target member formed in the image of an automobile tire.
Figure 18:
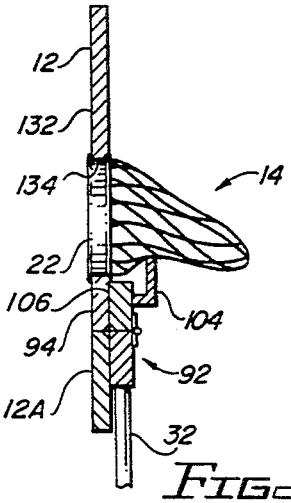
FIG. 18 is a cross sectional side view of the target member as described in FIG. 17.

With reference to FIGS. 17 and 18, an alternate embodiment of the target member 12 is presented in the image of an automobile tire 132 wherein the target member 12 is dimensioned to have an aperture 134 to better simulate the image of the automobile tire 132. The perimeter 12 of the target member 12 is formed into a circle representing the silhouette of the tire 132. In this embodiment, the container 14 is affixed to the target member 12 in such a way that the container opening 22 cooperates with the aperture 134 for receiving the object tossed at the target member 12. In the preferred embodiment, the closed portion 24 of the container 14 is made from a loose netting material for holding the object. As discussed earlier, the target member 12 is affixed to the bracket top portion 94 on the bracket back face 106 as was discussed with reference to FIG. 10 and shown in FIG. 18.

Figure 19:
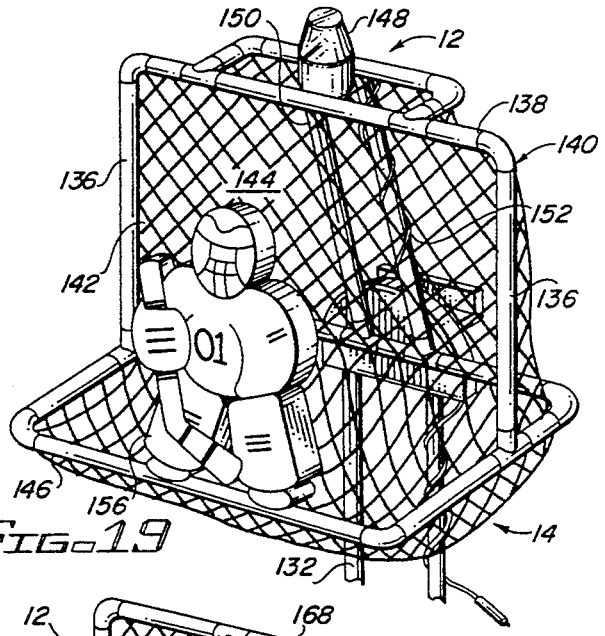
FIG. 19 is a target member formed in the shape of a hockey goal having a barrier in the image of a hockey goalie rotatably affixed to the target member.
Figure 20:
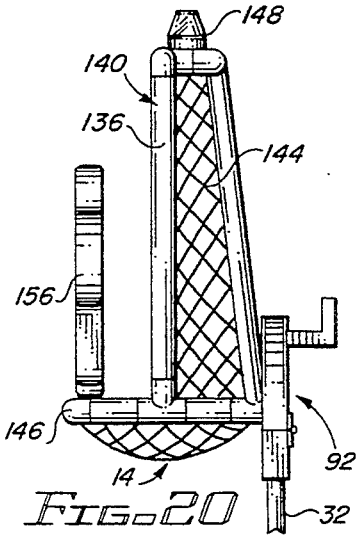
FIG. 20 is a partial side view of the target image of FIG. 19.

With reference to FIGS. 19 and 20, a preferred embodiment of the invention includes the target member 12 comprising a pair of elongated vertical members 136 separated by an elongated cross bar 138 thereby forming a frame 140 in an image of a hockey goal when an aperture 142 within the frame is filled with a netting material 144. The container 14 comprises an edge member 146 dimensioned for representing goal crease to a person tossing an object at the target member 12. A container 14 is affixed to the frame 140 thereby receiving and holding objects tossed at the target member 12. The hockey goal embodiment of the target member 12 further comprises a light 148 fixed to a top center portion 150 of the target member 12. The light 148 is turned on by the person operating the target 10 when an object tossed at the target 10 enters the container 14 thereby representing a successful toss. An electrical wire 152 is extended from the light 148 to a switch 154 positioned to be accessible to the person operating the target 10. As described earlier for alternate embodiments of the target member 12, the target member 12 is affixed to the bracket 92 for operation of the bracket 92 and tubular members 32, 34 and 36 and extending the target member 12 to a predetermined position 56 as illustrated in FIG. 6 to above the head of the person operating the target 10. Again with reference to FIG. 19, a barrier 156 in the form of a hockey goalie is rotatably affixed to the edge member 146. The barrier 156 is rotated by an object hitting the barrier 156. FIG. 20 illustrates in a side view of the target member 12, the barrier 156 rotatably affixed to the edge member 146 forward of the frame 140.

Figure 21:
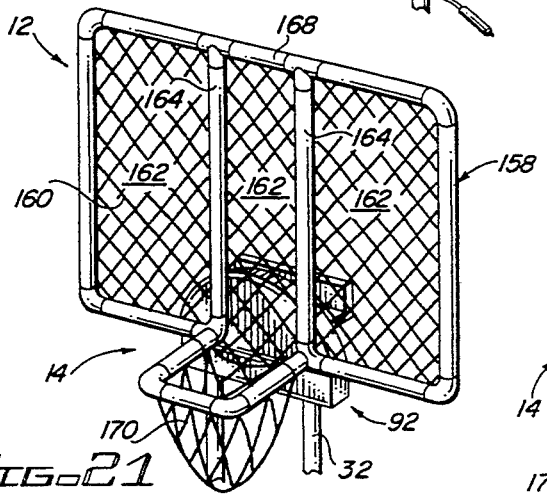
FIG. 21 is a perspective front view of a target member formed in the shape of an arena football post.
Figure 22:
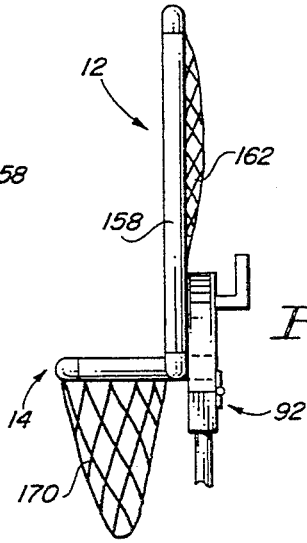
FIG. 22 is a partial side view of the arena football goal post target member described in FIG. 21.

With reference to FIGS. 21 and 22, the target member 12 in an alternate embodiment of the present invention comprises a rectangular frame 158 formed in the image of an arena football goal post. The frame 158 forms an aperture 160 enclosed by a net 162 stretched partially across the aperture 160. The frame 158 has a pair of vertical members 164 forming uprights for the arena goal post. The vertical members 164 form a center aperture 166 within the frame 168 with horizontal frame members 168 and the container 14. The net 162 loosely fills the center aperture 166. In addition a net 170 is used to form the container closed portion 20. As described in earlier descriptions of alternate embodiments of the target member 12, the target member is affixed to the bracket 92 for operation with the target 10. In order for an object tossed at the target member 12 to be contained within the container 14, the object must first hit the loosely formed net 162 within the uprights 164 as is typically the case for an arena football goal post.

Figure 23:
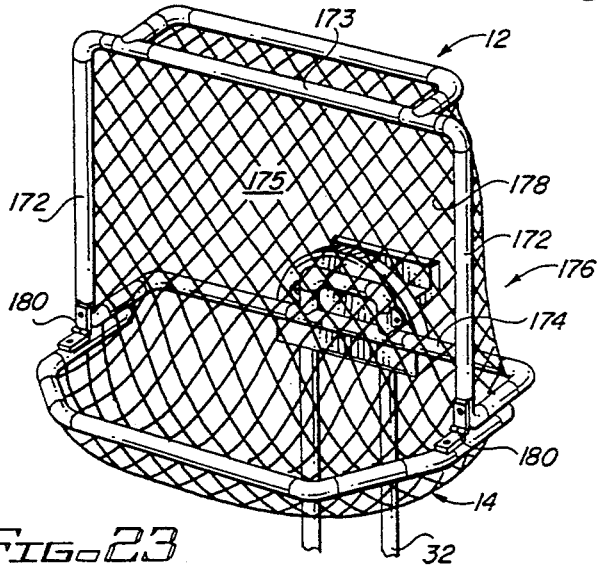
FIG. 23 is a perspective front view of a target member formed as a soccer goal.
Figure 24:
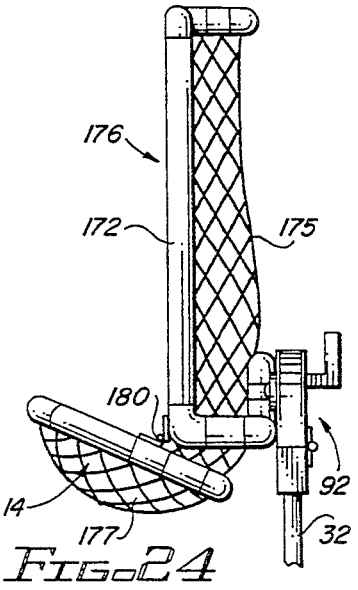
FIG. 24 is a partial side view of the soccer goal target member illustrated in FIG. 23.
Figure 26:
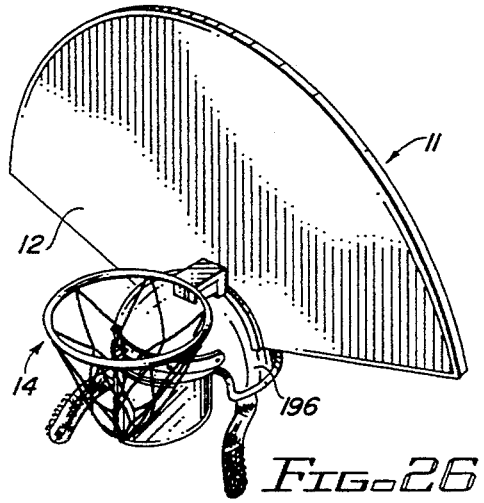
FIG. 26 is a front perspective view of a basketball hoop helmet illustrating an alternate embodiment of the present invention.
Figure 27:
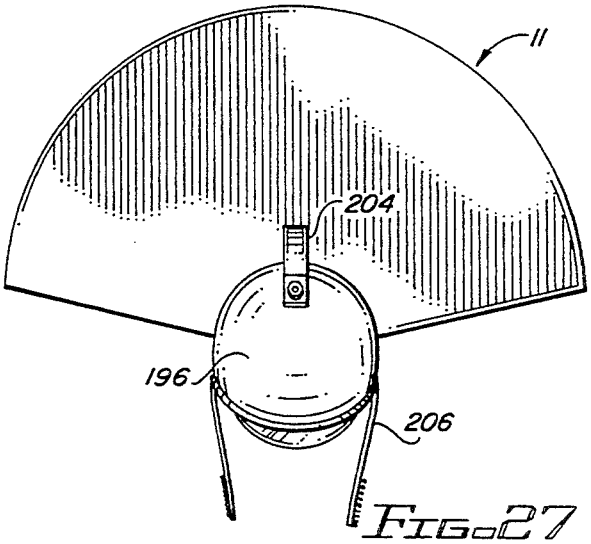
FIG. 27 is a rear elevational view of the basketball hoop helmet illustrated in FIG. 26.
Figure 28:
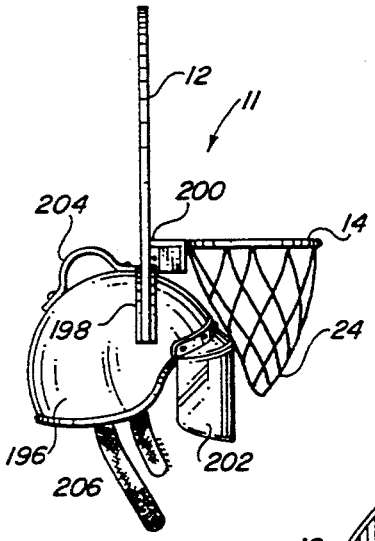
FIG. 28 is a side elevational view of the embodiment of FIG. 26.
Figure 29:
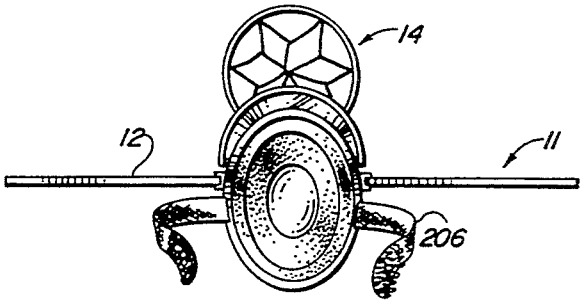
FIG. 29 is a bottom plan view of the embodiment illustrated in FIG. 26.
Figure 30:
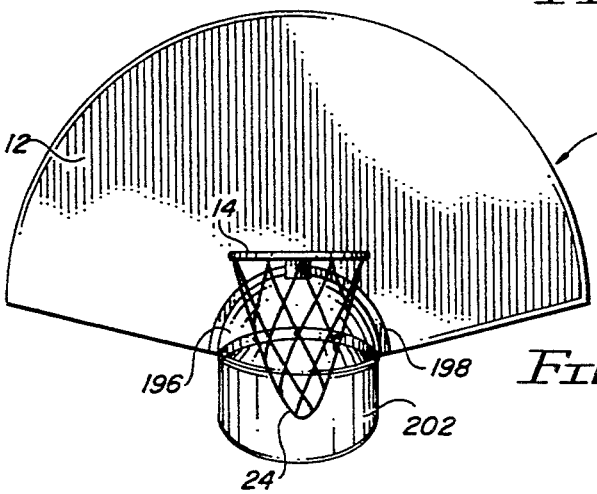
FIG. 30 is a front elevational view of the embodiment illustrated in FIG. 26.

With reference to FIGS. 23 and 24, the target member 12 in another embodiment, comprises a pair of elongated vertical members 172 separated by an elongated top cross bar 173 and an elongated bottom cross bar 174 thereby forming a frame 176 having an aperture 178. A frame 176 is formed in the image of a soccer goal. The container 14 is elongated to communicate with a lower elongated cross bar 174. The container 14 is rotatably affixed to a lower cross bar 174 for folding into a closed position when the bracket 92 is fixed within its second position 108 as was illustrated and discussed with reference to FIG. 11. The frame 176 is affixed to the upper portion 94 of the bracket 92 at the lower cross bar 74. In the preferred embodiment, a wire hinge member 180 is used to affix the container 14 to the lower cross bar 174. An image of a soccer goal is thus presented and further enhanced when the frame 176 shapes netting material 175 over the aperture 178. In addition netting material 177 is used to form the closed portion 24 of the container 14.

Again with reference to FIGS. 1–3, firing tubes 182 are affixed at locations on the backpack assembly 46 for access by the person operating the target 10. As illustrated in FIG. 25 the firing tubes 182 comprise a tube 184 closed at one end and open at a second end wherein an aperture is positioned for permitting material within a bore 188 of the tube 184 to be exited. A pressurized air container 190 is affixed to the tube closed end 192 for communicating with the bore 188 by injecting air into the tube bore 188 when a firing pin 194 punctures and exit end of the pressurized air container 190. In such a device, the operator of the target 10 causes paper filling the bore to be exited by air injected into the bore for purposes of celebrating a successful hit of the target.

With reference to FIGS. 26–30, an alternate embodiment is as described in the above referenced copending application to a basketball hoop helmet as the target 11. In such an embodiment the target member 12 is dimensioned to be affixed to a helmet 196 using a helmet mounting bracket 198. The helmet 196 is worn on the head of a person operating the target 11. The container 14 in the case of a basketball backboard as illustrated in FIGS. 26–30 is affixed to a front face of the target member 200 proximate the helmet bracket 198. A closed portion 24 of a container 14 drapes in front of the helmet 196. To protect the face of the person wearing the helmet 196 a shield 202 is affixed to the helmet 196 for placement between a person's face and objects tossed at the target member 12. With reference to FIGS. 31 and 32, it is appreciated that alternate target member embodiments can be affixed to the helmet as described. Comparison of FIGS. 31 and 32 illustrating a soccer goal target member 12 affixed to the helmet 196 with FIGS. 23 and 24 earlier described for the soccer goal target member 12 affixed to the bracket 94 for attachment to the telescopic tubes 32, 34 and 36 illustrate similar elements describing target members 12. In the preferred embodiment of the present invention illustrated in FIGS. 31 and 32, a modification is made to the container 14 so as to allow the container wire hinges 180 to rotate the container without interfering with the view of the person operating the target 11. The helmet bracket 198 affixes the helmet to the elongated member 174 of the soccer goal target member 12. A handle 204 is affixed to the helmet 198 for carrying the target 11 when not in use. Straps 206 are used to secure the helmet 196 to the head of the person operating the target 11. It can be appreciated by one skilled in the art that the target members 12 described herein can easily be adapted for use with the helmet 196 using a helmet mounting bracket 198. For this reason, it is understood that the earlier description fully covers the use of alternate target members with such a helmet 196 herein described.

Figure 33A:
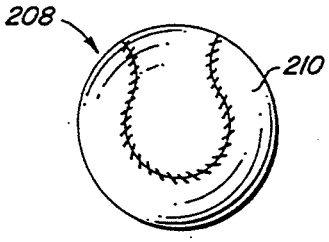
FIG. 33, by way of example, illustrates objects having various images for cooperating with target images.
Figure 33B:
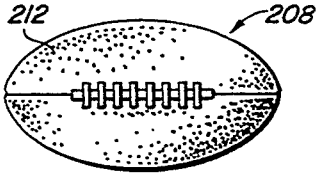
Figure 33C:
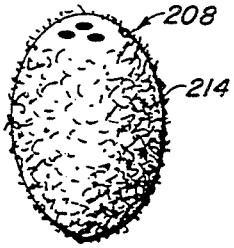

To complete an entertaining presentation and provide a true crowd pleaser, objects 208 as illustrated by way of example in FIGS. 33*a*, *b* and c are dimensioned to be comparable with the target members 12 with which they are used. By way of example, the target member 12 having an image of a baseball catcher 124 as described earlier with reference to FIGS. 15 and 16 has an object 208 dimensioned as a baseball 210 as illustrated in FIG. 33*a*. Likewise, target member 12 dimensioned to depict an arena football goal as earlier described is used with the object 208 to be tossed dimensioned as a football 212 as illustrated in FIG. 33*b*. These and other target member 12 and object 208 combinations satisfy the need to entertain fans at appropriate sporting events. The objects 208 in the present invention are made from a soft, material to avoid harming anyone should a poorly tossed object hit other than the target 10. By way of one final example, with reference to FIG. 33*c*, the target 10 dimensioned to appear as a palm tree with the target member 12 palm fronds and a curtain 114 as the trunk of the palm tree, has shown great success at a Jimmy Buffet concert, wherein the object 208 tossed at the palm tree is dimensioned as a coconut 214 as illustrated in FIG. 33*c*.

While specific embodiments of the invention have been described in detail herein above, it is to be understood that various modifications may be made from the specific details described herein without departing from the spirit and scope of the invention as set forth in the appended claims.

Having now described the invention, the construction, the operation and use of the preferred embodiment thereof, and the advantageous new and useful results obtained thereby, the new and useful constructions, and reasonable mechanical equivalents thereof obvious to those skilled in the art, are set forth in the appended claims.

What is claimed is:

1. A body supported sports target comprising:

a target member having an image affixed to a surface of the target member, the member having a perimeter dimensioned to form a silhouette of the image;

a container affixed to the target member, the container having an open portion for receiving an object tossed at the target member and a closed portion for holding the object;

a multiplicity of concentric generally tubular members each having distal ends and proximal ends, the members having an innermost tubular member and an outermost tubular member, the innermost tubular member distal end affixed to the target member;

means affixed to the tubular members for telescoping the concentric tubular members from a first position wherein the tubular member distal ends are proximate each other to a second position wherein the distal ends are separated by a distance sufficient to extend the target member a predetermined distance above a head of a person operating the target; and means for affixing the outermost tubular member to the person operating the target.

2. The target as recited in claim 1, further comprising:

a foldable bracket having a top portion rotatably affixed by a spring hinge to a bottom portion, the top portion affixed to the target member, the bottom portion affixed to the innermost tubular member distal end, the spring hinge biasing an end of the top portion against an end of the bottom portion for holding the portions in a first position within a single plane; and a hook member affixed to the top portion of the bracket for removably affixing the top portion to an intermediate tubular member in a second position parallel to the bottom portion, the intermediate tubular member biasing the top portion in a second plane parallel to the top portion when the distal ends are proximate each other and releasing the top portion as the concentric tubular members are telescoped and the distal ends are separated from each other.

3. The target as recited in claim 2, wherein the target member image comprises a portion of a palm tree and the perimeter is dimensioned to form a silhouette of palm fronds.

4. The target as recited in claim 3, further comprising a curtain member having a first end affixed to the bracket bottom portion and a second end affixed to the outer tubular member distal end, the curtain having an image of a palm tree trunk affixed to a surface of the curtain for viewing the target member and curtain in combination as a palm tree image when the tubular members are telescoped to the second position.

5. The target as recited in claim 4, wherein the container comprises a burlap woven mesh forming the container closed portion for receiving and holding an object formed in the image of a coconut tossed at the target by another person.

6. The target as recited in claim 2, wherein the multiplicity of concentric hollow generally tubular members comprise a multiplicity of pairs of the tubular members wherein the pairs are positioned in parallel for cooperating with each other.

7. The target as recited in claim 2, wherein the target member image comprises:

a baseball catcher in a squatting position;

the perimeter dimensioned in a silhouette of the catcher; and the container closed portion forming a catcher's mitt having finger and webbing portions making up the mitt for receiving and holding the object formed as a baseball.

8. The target as recited in claim 2, wherein the target member image comprises a circular backstop having an aperture within the center of the backstop for forming the image as an automobile tire and the container open portion communication with the aperture for receiving the object through the aperture and holding the object within the closed portion of the container, the closed portion formed from a loose netting material.

9. The target as recited in claim 2, wherein the target member comprises a pair of elongated vertical members separated by an elongated cross bar thereby forming the frame in an image of a hockey goal, the container having an edge member formed in front of the goal for representing a goal crease to a person tossing the object at the target.

10. The target as recited in claim 9, further comprising a light affixed to a top center portion of the goal, the light turned on by the person operating the target when the object tossed at the target enters the container thereby representing a successful toss.

11. The target as recited in claim 9, further comprising a barrier rotatably mounted on the edge member, the barrier dimensioned in an image of a hockey goalie, the barrier rotated by an object hitting the barrier, the object formed in the image of a hockey puck.

12. The target as recited in claim 2, wherein the target member comprises a pair of elongated vertical members separated by an elongated cross bar thereby forming the frame in an image of a soccer goal, the container rotatably affixed to goal lower members for folding into a closed position with the bracket top portion biased in the second plane.

13. The target as recited in claim 2, wherein the target member comprises a rectangular frame formed in the image of an arena football goal post, the frame having an aperture enclosed by a net stretched partially across the aperture, the frame having a pair of vertical members forming uprights of the arena goal post, the vertical members affixed within the frame, the vertical members forming a center aperture with horizontal frame members, the center aperture having a net portion loosely filling the remaining portion of the aperture, and the container having a net forming the closed portion.

14. The target as recited in claim 1, wherein the affixing means comprises a back pack assembly dimensioned to be strapped to the back of a person operating the target, the back pack having attachment means for affixing the backpack to the pair of outer tubular members.

15. The target as recited in claim 1, wherein the multiplicity of concentric hollow tubular members comprises a hollow tubular central member dimensioned to slidably fit within the outermost member, the central member having a bore dimensioned to receive the innermost member.

16. The target as recited in claim 15, wherein the telescoping means comprises:

a first pulley rotatably affixed to the outermost member distal end, the first pulley dimensioned to receive and direct a cable passing from within the outermost member to a position proximate a person operating the target;

a first cable having first and second ends, the cable first end affixed within the outermost member to the center member at the center member proximal end and extending from the proximal end through the first pulley to a position proximate a person operating the target, the position convenient for the person to hold a loop affixed within a cable second end for pulling the cable and causing the center member to telescope out of the outer member;

a second pulley rotatably affixed to the center member distal end, the second pulley dimensioned to receive and direct a cable passing from within the center member to a position proximate the outer member distal end; and a second cable having first and second ends, the cable first end affixed within the center member to the innermost member proximal end, the second cable extending from the innermost member proximal end through the second pulley to a position wherein the cable second end is affixed to the outermost tubular member distal end for causing the center member to telescope the innermost member out of the center member when the center member is telescoping out of the outermost member from the action of the person pulling on the first cable second end.

17. The target as recited in claim 1, wherein the container further comprises a rim, the rim having an aperture dimensioned for receiving the object and the closed portion formed from a netting material, the netting material dimensioned for holding the object.

18. A game using a body supported target in combination with an object for tossing the object at the target, the game comprising:

a target member having an image affixed to a surface of the target member, the member having a perimeter dimensioned to form a silhouette of the image;

a container affixed to the target member, the container having an opening for receiving an object tossed at the target member and a closed portion for holding the object therein;

means for removably affixing the target member to a person operating the target, the affixing means positioning the target member above a head of the person operating the target for receiving an object tossed at the target; and an object dimensioned to be received by the target member and held by the container, the object shaped in an image for cooperating with the image of the target member.

19. The game as recited in claim 18 wherein the target member image comprises a palm tree and the object an image of a coconut.

20. The game as recited in claim 18, wherein the target member image comprises a baseball catcher in a squatting position and the object an image of a baseball.

21. The game as recited in claim 20 wherein the container is dimensioned to form a catcher's mitt having fingers and webbing forming the container closed portion.

22. The game as recited in claim 18 wherein the target member image comprises an automobile tire.

23. The game as recited in claim 18 wherein the affixing means comprises a helmet having a bracket, the bracket affixing the helmet to the target member.

24. A method for placing a target in a position to receive an object tossed at the target by another person, the method comprising the steps of:

providing a target member having a perimeter and a surface defined by the perimeter;

affixing an image the surface of the target member;

dimensioning the perimeter to form a silhouette of the image;

affixing a container to the target member, the container having an open portion for receiving an object tossed at the target member and a closed portion for holding the object;

placing a multiplicity of concentric hollow generally tubular members each having distal ends and proximal ends within each other, the members having an innermost tubular member and an outermost tubular member;

affixing the innermost tubular member distal end to the target member;

affixing the outermost tubular member to a person operating the target for positioning the target member proximate the person's head;

providing means affixed to the tubular members for telescoping the concentric tubular members from a first position proximate the person's head wherein the tubular member distal ends are proximate each other to a second position wherein the distal ends are separated by a distance sufficient to extend the target member a predetermined distance above the head of the person operating the target;

raising the target member above the person's head;

tossing the object at the target member; and receiving the object and holding the object in the container closed portion.

25. The method as recited in claim 24, further comprising the steps of:

providing a foldable bracket having a top portion rotatably affixed by a spring hinge to a bottom portion, the spring hinge biasing an end of the top portion against an end of the bottom portion for holding the portions in a first position within a single plane;

affixing the bracket top portion to the target member;

affixing the bracket bottom portion to the innermost tubular member distal end;

providing a hook member;

affixing the hook member to the top portion of the bracket;

folding the target member for storing the member away from the face of the person by hooking the top portion to a portion of an intermediate tubular member for placing the target member in a second position parallel to the bottom portion, the intermediate tubular member biasing the top portion in a second plane parallel to the top portion when the distal ends are proximate each other and releasing the top portion as the concentric tubular members are telescoped and the distal ends are separated from each other; and partially telescoping the tubular members for unhooking the top portion from the intermediate tubular member thereby causing the spring hinge to position the target member in the first position for further lifting the target member above the head of the person.

26. The method as recited in claim 25, wherein the target member comprises a pair of elongated vertical members separated by an elongated cross bar thereby forming the frame in an image of a hockey goal, the container having an edge member formed in front of the goal for representing a goal crease to a person tossing the object at the target.

27. The method as recited in claim 26, further comprising the steps of:

affixing a light to a top portion of the goal; and turning on the light in response to the object tossed at the target coming to rest in the container.

28. The method as recited in claim 26, further comprising the step of affixing a barrier rotatably mounted on the edge member, the barrier dimensioned in an image of a hockey goalie, the barrier rotated by an object hitting the barrier.

29. The method as recited in claim 25, wherein the target member comprises a pair of elongated vertical members separated by an elongated cross bar thereby forming the frame in an image of a soccer goal, and the container is rotatable affixed to goal lower members for folding into a closed position when the bracket top portion biased in the second plane.

30. The target as recited in claim 25, wherein the target member comprises a rectangular frame formed in the image of an arena football goal post, the frame having an aperture enclosed by a net stretched partially across the aperture, the frame having a pair of vertical members forming uprights of the arena goal post, the vertical members affixed within the frame, the vertical members forming a center aperture with horizontal frame members, the center aperture having a net portion loosely filling the remaining portion of the aperture, and the container having a net forming the closed portion.

31. The method as recited in claim 24, wherein the image placing step further comprises the step of placing an image of a palm tree palm fronds portion on the target member surface and the perimeter dimensioning step comprises dimensioning the target member into a silhouette of a palm tree top portion having palm fronds.

32. The method as recited in claim 31, further comprising the steps of:

providing a curtain member expandable from a folded position to an extended position, the curtain member having first and second ends;

affixing an image of a palm tree trunk onto a surface of the curtain member;

affixing the curtain first end to the bracket bottom portion; and affixing the curtain second end to the outermost tubular member thereby causing the curtain member to extend to the extended position from the action of telescoping the tubular members from the first position to the second position.

33. The method as recited in claim 24, wherein the image placing step further comprises the step of placing an image of a baseball catcher in a squatting position, the perimeter dimensioning step comprises the step of dimensioning the target member into a silhouette on the catcher, and the container affixing step further comprises the step of forming the container from a baseball catcher's mitt, the mitt having fingers and webbing for forming the closed portion of the container.

34. The method as recited in claim 24, wherein the image placing step comprises the step of placing an image of an automobile tire onto the target member, the dimensioning step comprises the step of dimensioning the target member into a silhouette of an automobile tire, forming an aperture in a center of the target member for communicating with the container open portion, and the step of affixing the container further comprising the step of affixing the container open portion for communicating with the aperture for receiving the object through the aperture and holding the object within the closed portion of the container.

35. The method as recited in claim 24, wherein the step of affixing the outermost tubular member to the person further comprises the steps of:

providing a back pack assembly having straps adapted to be worn on the back of the person operating the target;

affixing the outermost tubular member to the assembly; and strapping the assembly to the person operating the target.

36. The method as recited in claim 24, wherein the multiplicity of tubular members is a multiplicity of pairs of tubular members, each of the pairs positioned parallel to each other for cooperating with each other.

37. A game using a body supported target in combination with an object for tossing the object at the target, the game comprising:

a target member having a pair of elongated vertical members and an elongated horizontal member affixed therebetween, the members having a perimeter dimensioned to form the target member in an image of a sports goal;

a container affixed to the target member, the container having an opening for receiving an object tossed at the target member and a closed portion for holding the object therein;

means for removably affixing the target member to a person operating the target; and an object dimensioned to be received by the target member and held by the container, the object shaped in an image for cooperating with the image of the target member.

38. The game as recited in claim 37 wherein the target member comprises the elongated members forming an image of a hockey goal, the container further having an edge member formed in a front portion of the goal for representing a goal crease to a person tossing the object at the target, and wherein the object is dimensioned as a hockey puck.

39. The game as recited in claim 37, wherein the target member comprises the elongated member forming an image of a soccer goal, and wherein the object is dimensioned in an image of a soccer ball.

40. The game as recited in claim 37, wherein the target member comprises the elongated member dimensioned to a rectangular frame formed in the image of an arena football goal post, the frame having an aperture enclosed by a net stretched partially across the aperture, the frame further having a pair of linear vertical members forming uprights of the arena goal post, the linear vertical members affixed within the frame, the inner vertical members forming a center aperture with the horizontal members, the center aperture having a net portion loosely filling a portion of the aperture, and wherein the object is dimensioned into an image of a football.

41. The game as recited in claim 37 wherein the affixing means comprises:

a backpack assembly dimensioned to be strapped to the back of a person operating the target, the backpack having attachment means for affixing the backpack to a tubular member;

a multiplicity of concentric generally tubular members each having distal ends and proximal ends, the members having an innermost tubular member, a center tubular member, and an outermost tubular member, the outermost tubular member affixed to the backpack assembly;

a foldable bracket having a top portion rotatably affixed by a spring hinge to a bottom portion, the top portion affixed to the target member, the bottom portion affixed to the innermost tubular member distal end, the spring hinge biasing an end of the top portion against an end of the bottom portion for holding the portions in a first position within a single plane;

a hook member affixed to the top portion of the bracket for removably affixing the top portion to an intermediate tubular in a second position parallel to the bottom portion, the intermediate tubular member biasing the top portion to a second plane parallel to the top portion when the distal ends are proximate each other and releasing the top portion as the concentric tube members are telescoped and the distal ends are separated from each other; and means affixed to the tubular members for telescoping the concentric tubular members from a first position wherein the tubular member distal ends are proximate each other to a second position wherein the distal ends are separated by a distance sufficient to extend the target member a predetermined distance above a head of a person operating the target.

* * * * *